US006775499B2

(12) United States Patent
Pan et al.

(10) Patent No.: US 6,775,499 B2
(45) Date of Patent: Aug. 10, 2004

(54) SYSTEM AND METHOD FOR CONTACT ELECTROSTATIC PRINTING

(75) Inventors: David H. Pan, Rochester, NY (US); Chu-heng Liu, Penfield, NY (US); Henry R. Till, East Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/321,982

(22) Filed: Dec. 17, 2002

(65) Prior Publication Data

US 2004/0114963 A1 Jun. 17, 2004

(51) Int. Cl.[7] ..... G03G 15/10
(52) U.S. Cl. ..... 399/237; 399/249
(58) Field of Search ..... 399/127, 128, 399/233, 249, 237–240, 296

(56) References Cited

U.S. PATENT DOCUMENTS 5,991,578 A * 11/1999 Liu et al. ..... 399/237 X
6,122,471 A * 9/2000 Liu et al. ..... 399/237
6,233,420 B1 5/2001 Liu et al. ..... 399/237
6,311,035 B1 * 10/2001 Liu et al. ..... 399/240

* cited by examiner

*Primary Examiner*—William J. Royer

(57) ABSTRACT

Method and apparatus for transferring a developed image from an image bearing member to a receiver substrate in a Contact Electrostatic Printing (CEP) system may be provided according to the present invention. The developed image is formed of a development material having a mixture of carrier fluid and pigmented polymeric particles, the composition of such mixture being selected for its characteristic behavior at an elevated temperature for transitioning to a substantially single phase. The method includes the steps of developing an image onto an image bearer using the aforementioned development material; concentrating the developed image; heating the developed image to a temperature at which the polymeric particles and the carrier fluid achieve a substantially single phase condition, so as to form a transferable image; and transferring the transferable image to a receiver substrate such as a paper sheet.

18 Claims, 2 Drawing Sheets

SYSTEM AND METHOD FOR CONTACT ELECTROSTATIC PRINTING

BACKGROUND OF THE INVENTION

The present invention relates generally to image reproducing systems, and more particularly relates to electrostatic latent image formation and development systems for providing a transferable image.

A typical electrostatographic printing process includes a development step whereby developing material including toner or marking particles is physically transported into the vicinity of a latent image bearing imaging member, with the toner or marking particles being caused to migrate via electrical attraction of toner or marking particles to the image areas of the latent image so as to selectively adhere to the imaging member in an image-wise configuration.

Various methods of developing a latent image have been described in the art of electrophotographic printing and copying systems. Of particular interest with respect to the present invention is the concept of forming a thin layer of liquid developing material on a first surface, wherein the layer has a high concentration of charged marking particles. The layer is brought into contact with an electrostatic latent image on another surface, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields. The developed image is typically formed on an image bearing member for subsequent transfer and fusing (transfusing) to a receiver substrate. In such printing methods, the image quality can vary significantly due to numerous conditions affecting such transfusing.

SUMMARY OF THE INVENTION

Embodiments of the present invention provide an improvement in performing contact electrostatic printing, and particularly for performing direct transfer of a developed image, formed on an image bearing member operable in a contact electrostatic printing system, to a wide range of receiver substrates.

Methods and apparatus for transferring and fusing a developed toner image from an image bearing member to a receiver substrate in a Contact Electrostatic Printing (CEP) system are provided according to the present invention. The developed toner image is formed of a development material, preferably having a mixture of carrier fluid and pigmented polymeric particles, the composition of such material being selected for its characteristic behavior at an elevated temperature for transitioning to a substantially single phase.

A method of contact electrostatic printing according to the present invention includes the steps of developing an image onto an image bearing member, the developed image being formed of the aforementioned development material; concentrating the developed image by processing the developed image so as to increase its solids content; heating the concentrated developed image to a temperature at which the mixture of pigmented polymeric particles and the carrier fluid achieve a substantially single phase; and transferring the concentrated developed image, now in a substantially single phase condition, to a receiver substrate such as a paper sheet.

A method of contact electrostatic printing according to the present invention includes the steps of: forming a uniform layer of liquid development material; charging the liquid development material layer to a first polarity; transforming the uniform layer to a toner cake layer by removing an upper portion of the layer via squeegee roll or self-gap reverse metering device, with appropriate bias applied to prevent developer material offset, to form a toner cake layer; transferring the toner cake layer to a photoreceptor having thereon an electrostatic latent image; reversing the toner cake layer charge in an image-wise fashion; separating the toner cake layer into a developed image and a background image, the developed image being developed onto a compliant image bearer; processing the toner cake layer in the developed image by increasing the solid content of the developed image to a high solids content level, e.g. in the range of 35 to 80%, by use of a fluid regulating device; heating the toner cake layer in the processed image to an elevated temperature above the phase-mixing temperature boundary of the toner cake to cause a transition to a substantially single-phase condition, thus forming a transferable image; and transferring the transferable image from the compliant image bearer to the receiver substrate.

An embodiment of the present invention includes apparatus for forming an image in a toner cake layer in accordance with a reverse charge contact electrostatic printing system (CEP), wherein the apparatus includes a first subsystem for forming the image and a second subsystem for developing the image to a compliant image bearer, and for concentrating and heating the toner cake layer as described above to provide a transferable image, with subsequent transfer of the transferable image. The compliant image bearer advantageously allows for transfer of the transferable image to a wide range of substrates.

An improved processed color image can be attained in embodiments of the present invention that employ a tandem or image-on-image (IOI) printing system architecture. No intermediate transfer belt is required in such printing systems.

The developer material preferably includes carrier liquid and pigmented polymeric or optionally non-pigmented polymeric particles, which form a substantially single phase at elevated temperatures. Pigment material in the toner particle is typically insoluble in toner resin or carrier fluid. In the description of the invention herein, the described single phase behavior is assumed to exclude typical pigments, and referring more specifically to the characteristic of a toner resin to form a substantially singe phase with a carrier fluid.

The present invention provides for an imaging system that employs a fluid regulating device to adjust the fluid content of a toner cake in order to prepare the toner cake for transition to the single phase condition. Such an imaging system includes a toner, cake applicator for applying toner cake onto a receiving member, a charging devil disposed so as to form an electrostatic latent image in the toner cake, a separation subsystem positioned relative to the receiving member so as to selectively separate at least a portion of the imaged toner cake from the receiving member, and a fluid regulating device for regulating the amount of fluid in the toner cake. For example, the fluid regulating device may be adapted to increase the concentration of toner particles in the toner cake by adjusting the amount of carrier fluid.

According to another aspect, the imaging system of the present invention further includes an imaging device positioned so as to apply an electrostatic latent image onto the receiving member prior to the application of the toner cake. The imaging device can include an image exposure station.

According to another aspect, the separation subsystem is adapted to receive at least a portion of the toner cake from the receiving member and for transferring at least a portion of the toner cake to a compliant substrate. The separation subsystem includes a compliant image bearing member for receiving a portion of the toner cake from the receiving member.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DESCRIPTION OF ILLUSTRATED EMBODIMENTS

The system of the present invention can be employed in a number of different types of image reproducing systems, examples of which include electrophotographic, electrostatic or electrostatographic, ionographic, and other types of image forming or reproducing systems that are adapted to capture and/or store image data associated with a particular object, such as a document. The system of the present invention is intended to be implemented in a variety of environments, such as in any of the foregoing types of image reproducing systems, and is not limited to the specific systems described below.

Figure 1:
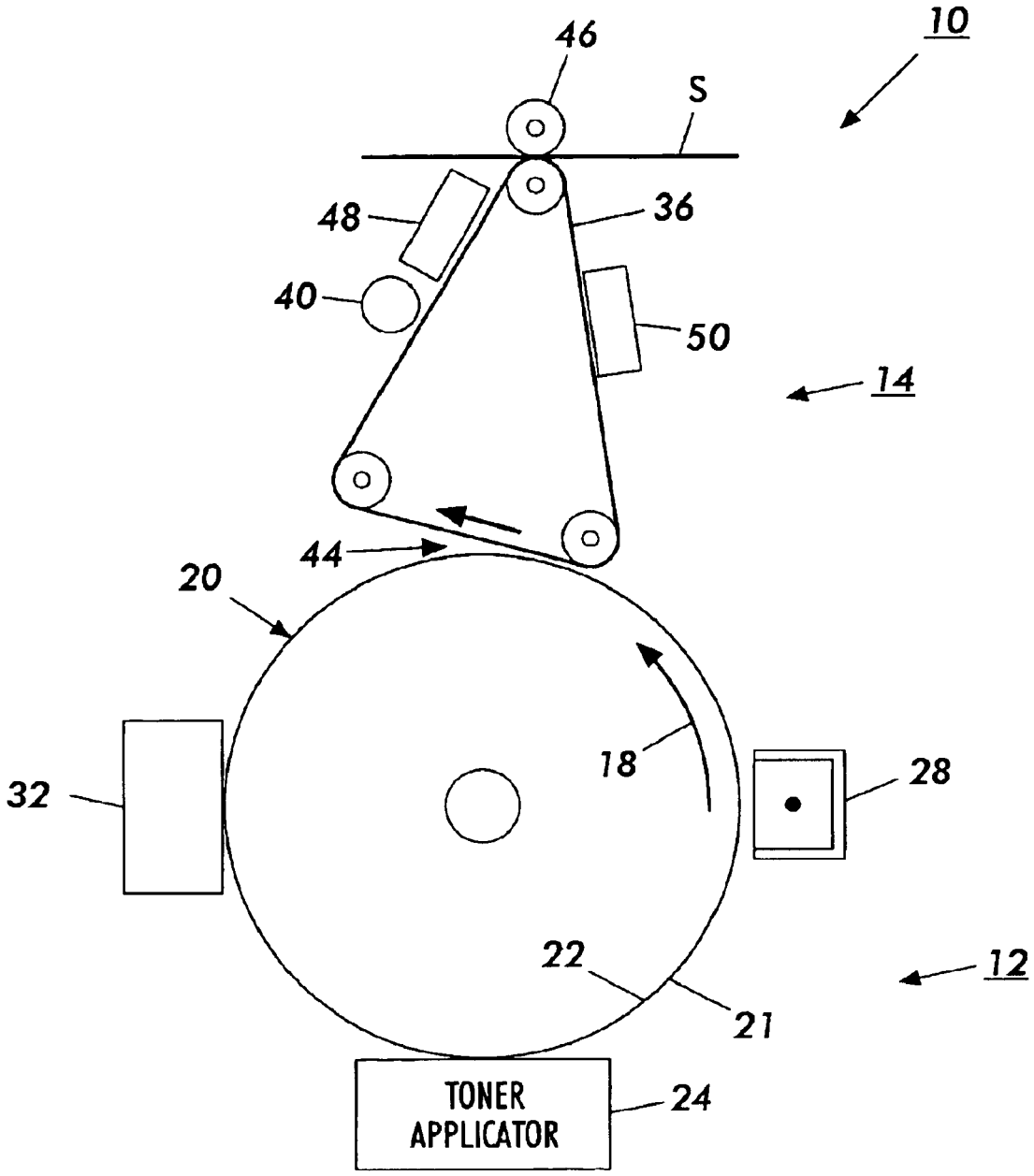
FIG. 1 is a schematic illustration of an image development and transfer system constructed in accordance with the teachings of the present invention.

With reference to FIG. 1, apparatus for transferring one or more transferable images from an image bearer to a receiver substrate is illustrated. The illustrated image development and transfer system 10 comprises an assemblage of operatively associated image-forming elements for depositing an image onto a receiving member, developing the image, and then transferring the developed image onto a receiver substrate.

The system 10 includes an image formation subsystem or stage 12 and a developed image subsystem or stage 14. The entire system 10 or one or more of the subsystems 12 and 14 can form part of any conventional image reproducing system. According to one embodiment, the image formation subsystem 12 can be an ionographic reverse charge printing (RCP) subsystem. The illustrated image formation subsystem 12 includes a receiving member 20 having an outer surface capable of receiving a layer of development material. An exemplary receiving member 20 can include a thin outer surface layer 21 composed of a conductive material, an insulative material, a dielectric material of the type known to those of ordinary skill in the art of ionography, a semiconductive material, or any other material suitable for use in electrostatographic imaging systems. The outer surface layer 21 of the receiving member 20 can be supported on an electrically conductive and preferably grounded support 22. Those of ordinary skill will readily recognize that various embodiments of the receiving member 20 can be employed consistent with the teachings of the present invention. For example, the image development and transfer system 10 can employ various types of receiving members well known in the art of electrostatographic printing including, but not limited to, a dielectric charge retaining member of the type generally used in ionographic printing machines.

The receiving member 20 is rotated by known means in a selected direction, such as in a counterclockwise process direction as illustrated by rotation arrow 18. The receiving member 20 is rotated so as to transport the outer surface layer 21 in a process direction for implementing a series of image forming steps in a manner similar to the contact electrostatic printing processes described herein.

In the illustrated image formation subsystem 12, a substantially uniform layer of charged or uncharged development material (having therein a mixture of, e.g., toner particles and a carrier liquid) can be deposited on the entire surface of the receiving member 20. In the illustrated embodiment, a toner applicator 24 houses a toner paste of cake that is applied by known processes to the outer surface layer 21 of the receiving member 20 to form a layer thereon. The toner cake can include toner particles carried in a suitable carrier medium. The toner cake within the reservoir can be applied to the receiving member 20 by an appropriate applicator (not shown), according to conventional roll coating methods, as well as other known processes and techniques.

The toner cake can be created in various ways. The toner cake can include charged or uncharged toner particles. In the case of a toner cake made up of charged toner particles, the charge can be placed on the toner particles while in the toner applicator 24, for example via ionic charge additives. Alternatively, the charge can be placed on the toner particles in the toner cake by any known ionic charging device, such as by charging device 28, as described in further detail below.

Depending on the materials utilized in the printing process, as well as other process parameters such as process speed and the like, the toner cake having sufficient thickness, preferably on the order of between 2 and 15 microns and more preferably between 3 and 8 microns, can be formed on the outer surface layer 21 of the receiving member 20 by merely providing adequate proximity and/or contact pressure between an applicator and the receiving member 20. Alternatively, in the case where the developing material comprises charged particles, electrical biasing may be employed to assist in actively moving the particles onto the outer surface layer 21 of the receiving member 20. Thus, according to one practice, an applicator roller mounted in the toner applicator 24 can be coupled to an electrical biasing source for implementing a called forward biasing scheme, wherein the applicator roller is provided with an electrical bias of sufficient magnitude to create electrical fields extending from the applicator roller to the outer surface layer 21 of the receiving member 20. These electrical fields cause toner particles to be transported to the outer surface layer 21 of the receiving member 20 for forming substantially uniform layer of toner cake.

It will be understood that various other devices or apparatus can be utilized for applying toner cake to the receiving member 20, including various wall known apparatus analogous to development devices used in conventional electrostatographic applications, such as, but not limited to, powder cloud systems which transport developing material through a gaseous medium such as air, brush systems which transport developing material to a toner layer support member by means of a brush or similar member, and cascade systems which transport developing material to a toner layer support member by meant of a system for pouring or cascading the toner parties onto the surface of a receiving member. In addition, various systems directed toward the transportation of liquid developing material having toner particles immersed in a carrier liquid can be incorporated into the present invention. Examples of such a liquid transport system can include a fountain device as disclosed generally in commonly assigned U.S. Pat. No. 5,519,473. (incorporated by reference herein), or any other system capable of causing the flow and transport of liquid developing material, including toner particles immersed in a liquid carrier medium, onto the surface of the receiving member 20. It is noted that, in the case of liquid developing materials, it is desirable that the toner cake formed on the outer surface layer 21 of the receiving member 20 can be in the range between about 15% and about 35% by weight toner solids, and preferably comprised of not less than 20% by weight toner solids.

With respect to the foregoing toner cake formation process and various apparatus therefor, it will be understood that the toner cake generated on the receiving member 20 can be characterized as having a substantially uniform mass density per unit area. However, it is noted that some toner cake non-uniformity may be generated such that it is not a requirement of the present invention that the toner cake be uniform or even substantially uniformly distributed on the surface of the receiving member 20, so long as the toner layer covers, at a minimum, the desired image areas of the output image to be produced.

Referring again to FIG. 1, after the toner cake is deposited on the surface of the receiving member 20, the toner cake is charged in an image-wise manner by the charging device 28. The illustrated charging device 28, which can include a well known ionographic writing head/electron imaging beam, is arranged and adapted for producing and introducing free mobile ions into the toner cake disposed on the receiving member 20. The image-wise ion stream generated by the charging device 28 causes the toner particles in the toner cake to become selectively charged in an image-wise manner for generating an electrostatic latent image in the toner cake composed of toner particles having distinguishable charge polarities and levels in image and non-image (e.g. background) areas corresponding to the image. Once the latent image is formed in the toner cake, the latent image bearing toner cake is advanced to the developed image subsystem 14.

According to one embodiment, as illustrated in FIG. 1, the developed image subsystem 14 can employ an image separator provided in the form of a compliant image bearing member 36 (e.g., belt) entrained about a set of rollers for receiving or separating the image from the toner cake disposed on the receiving member 20, and for transporting the image to a substrate S. The image bearing member 36 can be driven by and suitable driving device. The illustrated image bearing member 36 can be any transfer apparatus readily recognizable to those of ordinary skill in the art. For example, the image bearing member 36 can be formed as a biased roll member.

The image bearing member 36 of the developed image subsystem 14 facilitates development of at least a portion of the toner cake from the receiving member 20 to the image bearing member 36. The development of the toner cake between the subsystems 12 and 14 can be effected according to known and well characterized techniques. The image portions of the toner cake can be developed and transferred to the image bearing member 36 of the developed image subsystem 14. Meanwhile, the non-image or background portions of the image in the toner cake can remain on the receiving member 20.

The background portion of the image which remain in the toner cake can be removed from the receiving member 20 by any known technique, such as by the toner removal element 32. The illustrated toner removal element 32 can be any appropriate scraper or blade cleaning apparatus suitable for scraping the receiving member surface as is well known in the art. Alternative embodiments can include a brush or roller member for removing the toner cake from the surface on which it resides.

The toner concentration and viscosity within the toner cake is adjusted with a fluid regulating device 40 so as to achieve a high solids content, the level of which is preferably in the range of 35 to 80 percent solids. The illustrated fluid regulating device 40 regulates or adjusts the fluid constituent of the toner cake, such as by removing fluid thereto, in order to regulate the toner concentration and viscosity. The fluid regulating element can also directly or indirectly apply or remove a uniform or non-uniform amount of fluid to the toner cake, in a continuous or intermittent manner. The illustrated fluid regulating device 40 can regulate the fluid content in the toner cake and hence the toner concentration and viscosity.

The fluid regulating device 40 can be any conventional fluid dispensing device suitable for dispensing a selected amount of liquid at a predetermined location, or for dispensing a selected amount of fluid, such as isopar, to a selected location. The fluid regulating device 40 can introduce a selected amount of liquid to the toner cake to decrease the toner concentration or conversely, if the toner concentration is below a desired level, liquid can be removed from the toner cake, directly or indirectly, in order to increase the toner concentration to a desired range. Examples of suitable devices include liquid injection systems, blowers, slots, holes, blotters and squeegee rolls, and the like.

The developed image portion of the toner cake on the image bearing member 36 can then be processed for optimal transfer to the substrate S according to the teachings herein for achieving a process developed image that exhibits substantially single phase condition. The processing ides employing a heating stage 48. According to an alternate technique, a heated press roll arrangement 46 provides for not only heating but also pressure transferring and fixing the developed image from the image bearing member 36 to the substrate S. At least one of the heating stage 48 or heated press roll arrangement 46 is employed to elevate the temperature of the toner image above its particular phase mixing temperature boundary, so as to the transition to a substantially single-phase condition prior to transfer to the substrate S. Those of ordinary skill in the art will readily recognize that the heating stage 48 may be constructed to employ known heating apparatus.

If the image is not completely transferred onto the substrate S, a cleaning device 50 can be employed to remove any residual toner cake that remains on the image bearing member 36.

Those skilled in the art will recognize that a conventional image reproducing system may employ a system controller for controlling one or more portions of the image forming process. In accordance with the present invention, the system controller can be employed to regulate the development and transfer of the image within and between the image formation and image developed image subsystems 12 and 14. Moreover, the system controller can be employed to control the operation of the fluid regulating device 40 and the heating stage 48 or heated press roll arrangement 46. According to one practice, the system controller can be employed in connection with one or more sensors in order to monitor the temperature of the toner cake and the fluid level or content within the toner cake during the image development process. The information generated by the sensors can be employed in connection with the system controller to determine the amount of heat and/or fluid that may need to be added or removed from the toner cake.

In operation, an input image which is desired to be copied to a substrate S is rendered in a system compatible format, such as in a digitized form, for subsequent transfer to the toner cake layer applied on a surface of the receiving member 20. The digital image data can be applied in an image-wise manner directly to the toner cake by the charging device 28. According to one practice, the image formation subsystem 12 can be constructed as an ionographic RCP system, and hence the charging device 28 can deposit free mobile ions into the toner cake. The image and non-image portions of the toner cake can then be separated at the development nip 44.

The fluid regulating device 40 of the present invention can be employed to adjust or regulate the fluid content of the toner cake such as by removing or adding fluid. The fluid regulating device 40 can be disposed at any suitable location in the illustrated image development and transfer system 10, and can be used in connection with either or both of the subsystems 12 and 14.

Figure 2:
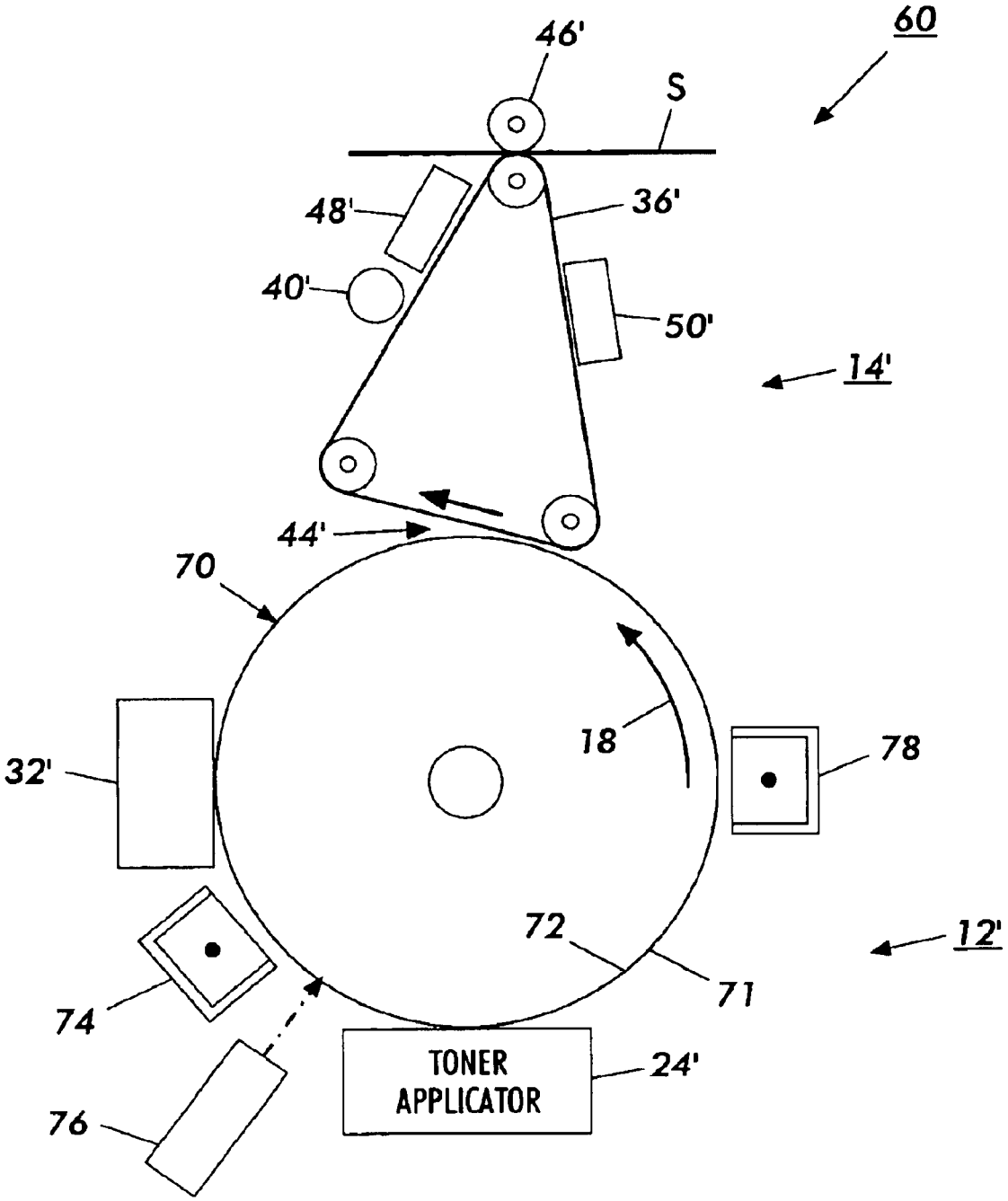
FIG. 2 is a schematic illustration of an alternate embodiment of the image development and transfer system of FIG. 1.

FIG. 2 illustrates an alternate embodiment of the image development and transfer system of FIG. 1. The system 60 illustrated in FIG. 2 is directed to a contact electrostatic printing system that employs a photoconductive receiving member 70. Like parts are illustrated throughout the views with same reference numeral plus a superscript prime.

With reference to FIG. 2, the illustrated image development and transfer system 60 comprises an assemblage of operatively associated image forming elements for depositing an image onto a receiving member, developing the image, and then transferring the developed image onto a substrate. The system 60 includes an image formation subsystem or stage 12' and developed image subsystem or stage 14'. The system 60 or the subsystems 12' and 14' can form part of any conventional image reproducing system. The illustrated subsystem 12' includes a receiving member 70 that optionally includes a conventional photoconductor or photoreceptive surface component of the type known to those of ordinary skill in the art. As is known, the receiving member can have a surface layer 71 having photoconductive properties, and can be supported by an appropriate support assembly. Alternate forms of the receiving member 70 can also be used, and which would be obvious to those of ordinary skill. For example, although the system 60 incorporates a photoconductive imaging member, it will be well understood that the present invention contemplates the use of various other imaging members, such as non-photosensitive imaging members of the type used in ionographic systems.

The receiving member 70 is rotated by known means in a selected direction, such as in a counterclockwise process direction as illustrated by rotation arrow 18. The receiving member 70 is rotated so as to transport a photoconductive surface thereof in a process direction for implementing a series of image forming steps in a manner similar to typical electrostatographic printing processes.

The surface of the receiving member 70 can pass by a charging device 74 for applying an electrostatic charge to a photoconductive surface 71 of the receiving member 70. The charging device 74 is provided for charging the photoconductive surface 71 of the receiving member 70 to a selected potential, such as a relatively high, substantially uniform potential. It will be understood that various charging devices, such as charge rollers, corona generating devices, charge brushes and the like, as well as induction and semiconductive charge devices among other devices which are well-known in the art, can be utilized as the charging device for applying a charge potential to the surface of the receiving member 70.

After the receiving member 70 is charged to a substantially uniform charge potential, the charged photoconductive surface 71 is advanced to an image exposure station 76. The image exposure station 76 projects a light image corresponding to an input image onto the surface 71. In the case of an imaging system having a photosensitive receiving member, the light image projected onto the surface 71 of the receiving member 70 selectively dissipates the charge thereon for recording an electrostatic latent image on the photoconductive surface 71. The electrostatic latent image comprises image areas defined by, for example, a first charge voltage, and non-image or background areas defined by, for example, a second charge voltage different from the first charge voltage. The charged image configuration corresponds to the input image informational areas. The image exposure station 76 may incorporate various optical image formation and projection components as are known in the art, and may also include various well known light lens apparatus or digital scanning systems for forming and projecting an image from an original input document onto the receiving member 70. The charge polarity of the image/non-image areas are known and well-characterized in the art.

In a typical electrostatographic printing process, the electrostatic latent image can be generated on the surface of the receiving member 70, if desired. The image can then be developed into a visible image by depositing thereon a developing material. In the illustrated embodiment, a toner applicator 24' houses a toner paste or cake that is applied to the entire surface 71 of the receiving member 70. The presence of the electrostatic latent image on the receiving member 70 can generate some fringe fields in areas of interface between image and non-image areas of the latent image. However, the effects of this field on the toner cake are minimal relative to the fields associated with conventional electrostatic latent image development such that, although some toner layer non-uniformity may result, the toner layer can be characterized as having a substantially uniform density per mass area in both image and non-image areas.

Referring again to FIG. 2, after the toner cake is deposited on the surface of the receiving member 70, the toner cake is charged in an image-wise manner by a recharging device 78. The illustrated recharging device 78, which can include a well known scorotron device, is arranged and adapted for introducing free mobile ions in the vicinity of the charged latent image, to facilitate the formation of an image-wise ion stream extending from the recharging device 78 to the latent image on the surface of the receiving member 70. The image-wise ion stream generated by the recharging device 78 generates a secondary latent image on the toner cake, and can be composed of oppositely charged toner particles disposed in an image configuration corresponding to the first or initial latent image generated on the receiving member 70. The system 60 can be constructed so as to form first and second latent images, such as a first latent image on the surface of the receiving member 70, and a second latent image on the toner cake. The use and formation of multiple latent images in an image forming system is set forth and described in the aforementioned U.S. Pat. No. 5,828,147, the disclosure of which is incorporated herein by reference and need not be described in greater detail.

Once the latent image (e.g., first or second latent image) is formed in the toner cake, the latent image bearing toner cake is advanced to the developed image subsystem 14'. According to ore embodiment, as illustrated in FIG. 2, the developed image subsystem 14' can employ an image separator provided in the form of compliant image bearing member 36' (e.g., belt) entrained about a set of rollers for receiving or separating and developing the image from the toner cake disposed on the receiving member 70, and for transporting the image to the substrate S.

The illustrated fluid regulating device 40' can regulate the fluid content in the toner cake in order to regulate or adjust the toner concentration and hence toner viscosity.

With further reference to FIG. 2, the image bearing member 36' of the developed image subsystem 14' facilitates development of at least a portion of the toner cake from the receiving member 70 to the image bearing member 36'. The transfer of the toner cake between the subsystems 12' and 14' can be effected according to known and well characterized techniques. The image or non-image (e.g., background) portions of the toner cake can be transferred to the image bearing member 36' of the developed image subsystem 14'. Meanwhile, the non-image or background portions of the image in the toner cake remain on the receiving member 70.

The background portion of the image which remains in the toner cake can be removed from the receiving member 70 by any known technique, such as by the toner removal element 32'.

The image portion of the toner cake which is transferred from the receiving member 70 to the image bearing member 36' can then be transferred to the substrate S according to known and well characterized techniques. A heated press roll arrangement 46' for pressure transferring and fixing the developed image from the image bearing member 36' to the substrate S. A heating stage 48' can be employed to elevate the temperature of the image above the phase mixing temperature boundary prior to transfer to the substrate S. If the image is not completely transferred onto the copy substrate S, a cleaning device 50' can be employed to remove any residual toner cake that remains on the image bearing member 36'.

An example of an ionographic image development system for creating a latent image in a toner layer on a support member is disclosed in U.S. Pat. No. 5,966,570, the disclosure of which is herein incorporated by reference. An example of an image development system for creating a latent image in a toner layer on a support member is disclosed in U.S. Pat. No. 5,826,147, the contents of which are herein incorporated by reference.

For the purposes of the foregoing description, the concept of latent image development via direct surface-to-surface transfer of a toner layer via image-wise fields has been identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; 5,619,313; 6,122,471; 6,195,520; 6,219,501; 6,233,420; 6,256,468; and 6,289,191; the disclosures of which are incorporated herein by reference.

EXAMPLE

A phase diagram was mapped out in a temperature-composition plot for the DuPont Nucrel 599 resin and carrier fluid isopar M. The data indicate that there exists a single-phase region between the resin and carrier. The triple point of the phase diagram has a phase composition of approximately 35–55% resin and a temperature of approximately 65–80°C. It was found that a number of resins form substantially a single phase with hydrocarbon carrier fluid when subjected to an elevated temperature. The resins include the DuPont Nucrel resin family, and the like. Some polyester or polyamide toner resins imbibe little or no carrier fluid; in such instances, the resin and carrier fluid may not be sufficiently compatible with each other so as to form a singe-phase material.

What is claimed is:

1. An imaging system, comprising a toner cake applicator for applying a toner cake onto a toner cake receiving member, a charging device disposed so as to form an electrostatic latent image in the toner cake, a separation subsystem positioned relative to the receiving member for separating at least a portion of the imaged toner cake from the receiving member and for transferring the portion of the imaged toner cake onto an image bearing member, a fluid regulating device for regulating the amount of fluid in the transferred toner cake portion so as to effect a predetermined high level of solids content;

a heating device for heating the transferred toner cake portion to an elevated temperature to cause it to transition to a substantially single-phase condition, thus forming a transferable image; and an image transfer device for transferring the transferable image from the image bearing member to a receiver substrate.

2. The imaging system of claim 1, wherein the fluid regulating device is operable to adjust the solids content in the loner cake to a level in the range of from about 35 percent to about 80 percent solids content.

3. The imaging system of claim 1, wherein the fluid regulating device is adapted to remove fluid from said toner cake.

4. The imaging system of claim 1, wherein the heating device is operable to adjust the temperature of the toner cake to a predetermined level above the phase-mixing temperature boundary of the toner cake.

5. The imaging system of claim 1, wherein the toner cake is formed of development material that comprises a mixture of pigmented polymeric particles and carrier fluid.

6. The imaging system of claim 5, wherein the elevated temperature is at least a predetermined temperature at which the mixture of the pigmented polymeric particles and carrier fluid will transition to a single-phase condition.

7. The imaging system of claim 1, further comprising an imaging device positioned so as to apply an electrostatic latent image onto the receiving member.

8. The imaging system of claim 7, wherein said imaging device comprises an image exposure station.

9. The imaging system of claim 1, wherein said image transfer device comprises a compliant image bearing member positioned to receive the portion of the imaged toner cake, and to transfer the transferable image to the receiver substrate.

10. A method of contact electrostatic printing, comprising the steps of:

forming a uniform layer of liquid development material;

charging the liquid development material layer to a first polarity;

transforming the uniform layer to a toner cake layer;

transferring the toner cake layer to a receiving member having thereon an electrostatic latent image;

altering the toner cake layer charge in an image-wise fashion;

separating the toner cake layer into a developed image portion and a background image portion, the developed image portion being transferred onto an image bearing member;

processing the developed image portion by increasing the solid content of the developed image portion to a high solids content level to provide a processed image portion;

heating the processed image portion to an elevated temperature to cause it to transition to a substantially single-phase condition, thus forming a transferable image; and transferring the transferable image from the image bearing member to a receiver substrate.

11. The imaging method of claim 10, wherein the processing step further comprises adjusting the solids content in the developed image portion to a level in the range of from about 35 percent to about 80 percent solids content.

12. The imaging method of claim 10, wherein the processing step further comprises removing fluid from the developed image portion.

13. The imaging method of claim 10, wherein the development material comprises a mixture of pigmented polymeric particles and carrier fluid.

14. The imaging method of claim 13, wherein the elevated temperature is at least a predetermined temperature at which the mixture of the pigmented polymeric particles and carrier fluid will transition to a single-phase condition.

15. The imaging method of claim 10, wherein the heating step further comprises adjusting the temperature of the toner cake to a predetermined level above the phase-mixing temperature boundary of the toner cake.

16. The imaging method of claim 10, wherein the charge altering step further comprises applying an electrostatic latent image onto the receiving member.

17. The imaging method of claim 10, wherein the charge altering step further comprises providing an image exposure.

18. The imaging method of claim 10, wherein the separating step further comprises transferring the developed image portion to a compliant image bearing member.

* * * * *